US006760947B2

(12) United States Patent
Stuchlik

(10) Patent No.: US 6,760,947 B2
(45) Date of Patent: Jul. 13, 2004

(54) APPARATUS FOR TREATING A FLOOR SURFACE UTILIZING A HANDLE MOUNTED TRAVERSE SWITCH

(75) Inventor: William R. Stuchlik, Rogers, AR (US)

(73) Assignee: Alto U.S. Inc., Chesterfield, MO (US)

( * ) Notice: Subject to any disclaimer, the term of this patent is extended or adjusted under 35 U.S.C. 154(b) by 340 days.

(21) Appl. No.: 09/934,141

(22) Filed: Aug. 21, 2001

(65) Prior Publication Data

US 2002/0073494 A1 Jun. 20, 2002

Related U.S. Application Data

(60) Provisional application No. 60/227,092, filed on Aug. 22, 2000.

(51) Int. Cl.[7] ..... A47L 9/32; A47L 11/00

(52) U.S. Cl. ..... 15/49.1; 15/50.2; 15/79.1; 15/98; 15/410

(58) Field of Search ..... 15/49.1, 50.1, 15/79.1, 79.2, 98, 320, 340.1, 340.2, 410

(56) References Cited

U.S. PATENT DOCUMENTS

| | | | | |
|---|---|---|---|---|
| 1,447,751 | A | | 3/1923 | Blackburn |
| 1,572,913 | A | | 2/1926 | Finnell |
| 1,740,634 | A | | 12/1929 | Wettlaufer |
| 3,021,550 | A | | 2/1962 | Stratford |
| 3,063,082 | A | | 11/1962 | Rosenberg |
| 3,277,511 | A | | 10/1966 | Little et al. |
| 3,345,671 | A | | 10/1967 | Wilson et al. |
| 3,837,028 | A | | 9/1974 | Bridge |
| 3,866,541 | A | | 2/1975 | O'Connor et al. |
| 4,014,067 | A | | 3/1977 | Bates |
| 4,037,289 | A | | 7/1977 | Dojan |
| 4,173,056 | A | | 11/1979 | Geyer |
| 4,363,152 | A | | 12/1982 | Karpanty |
| 4,409,702 | A | | 10/1983 | Brown |
| 4,429,433 | A | | 2/1984 | Burgoon |
| 4,490,873 | A | | 1/1985 | Stratton |
| 4,492,002 | A | | 1/1985 | Waldhauser et al. |
| 4,590,340 | A | | 5/1986 | Koike et al. |
| 4,624,027 | A | | 11/1986 | Martin |
| 4,654,924 | A | | 4/1987 | Getz et al. |
| 4,674,142 | A | | 6/1987 | Meili |
| 4,759,094 | A | | 7/1988 | Palmer et al. |
| 4,763,741 | A | * | 8/1988 | Torta ..... 15/50.1 |
| 4,809,397 | A | * | 3/1989 | Jacobs et al. ..... 15/320 |
| 4,825,500 | A | | 5/1989 | Basham et al. |
| 4,845,803 | A | | 7/1989 | King |
| 4,937,911 | A | | 7/1990 | Picchietti, Sr. et al. |
| 5,016,310 | A | | 5/1991 | Geyer et al. |
| 5,212,848 | A | | 5/1993 | Geyer |
| 5,231,724 | A | | 8/1993 | Haaga |
| 5,265,300 | A | | 11/1993 | O'Hara et al. |

(List continued on next page.)

FOREIGN PATENT DOCUMENTS

| | | |
|---|---|---|
| FR | 1271628 | 4/1961 |
| JP | 3-144004 | 6/1991 |
| JP | 6-154143 | 6/1994 |

*Primary Examiner*—Theresa T. Snider
(74) *Attorney, Agent, or Firm*—Blackwell Sanders Peper Martin, LLP

(57) ABSTRACT

Apparatus for treating a floor surface includes a wheeled vehicle having a floor surface treating unit, a drive motor operable to propel the wheeled vehicle and a control system for controlling operation of the apparatus. A handle is mounted on the wheeled vehicle and has a traverse switch unit for selectively operating the apparatus between a traverse mode in which the vehicle is propelled by the drive motor to move relative to the floor surface and an idle mode in which the drive motor is ineffective to propel the vehicle. The traverse switch unit is mounted on the handle such that the traverse switch unit is accessible for movement by the operator toward the first position of the traverse switch unit corresponding to the traverse mode of the apparatus without the operator having to generally release the handle.

15 Claims, 14 Drawing Sheets

U.S. PATENT DOCUMENTS 5,365,803 A 11/1994 Kelley et al.
5,426,805 A * 6/1995 Fisher ..... 15/79.2
5,454,138 A 10/1995 Mondigo et al.
5,520,066 A 5/1996 Tueri
5,524,320 A 6/1996 Zachhuber
5,742,966 A 4/1998 Tono
5,742,975 A 4/1998 Knowlton et al.
5,808,374 A 9/1998 Miller et al.
5,855,144 A 1/1999 Parada
6,073,303 A * 6/2000 Hinojosa ..... 15/385
6,085,382 A * 7/2000 Bobrosky et al. ..... 15/350
6,202,243 B1 * 3/2001 Beaufoy et al. ..... 15/49.1
6,355,112 B1 * 3/2002 Bartholmey et al. ..... 15/340.2

* cited by examiner

APPARATUS FOR TREATING A FLOOR SURFACE UTILIZING A HANDLE MOUNTED TRAVERSE SWITCH

CROSS-REFERENCE TO RELATED APPLICATIONS

This application claims the benefit of U.S. Provisional Patent Application 60/227,092, filed Aug. 22, 2000, which is herein incorporated by reference in its entirety for all purposes.

BACKGROUND OF THE INVENTION

This invention generally relates to apparatus, such as a floor scrubber, for treating a floor surface. In particular, the apparatus as herein disclosed is regarded as involving three distinct inventions, including an improved head assembly, an improved operating control system, and an improved squeegee assembly, the improved operating control system constituting the invention claimed herein.

Floor scrubbers are typically classified in terms of the cleaning path width defined by the laterally outermost extent of the scrub brushes relative to the forward direction of travel of the floor scrubber. Conventional floor scrubbers are manufactured to sweep a cleaning path of fixed width. Choosing the right floor scrubber depends largely on the floor space and obstructions in the floor plan of the area being cleaned. A scrubber having a large cleaning path width is used to clean large, open floor spaces while a scrubber having a narrower cleaning path width is used to scrub in tight areas and narrow isles.

Conventional floor scrubbers also have a control system in electrical connection with the various operating components of the scrubber. A handle is provided for grasping by the operator to maneuver the scrubber. The scrubbers are typically provided with a drive motor for self-propelling the scrubber to move over the floor surface being cleaned, and a traverse switch unit for operating the scrubber between an idle mode and a traverse mode in which the motor is operated to self-propel the scrubber. One disadvantage of these conventional floor scrubbers is that the traverse switch unit is mounted on the scrubber separate from the handle, requiring the operator to let go of the handle while switching the scrubber from the traverse mode to the idle mode, increasing the risk of impacting the scrubber into a wall or other obstacle.

Finally, conventional floor scrubbers typically include a squeegee assembly for sweeping dirty solution from the floor surface and directing the dirty solution to a recovery system that suctions the dirty solution from the floor surface, leaving a clean floor. One disadvantage associated with conventional floor scrubbers is that the blades of the squeegee assembly are secured thereto by multiple screw fasteners, making replacement of the blades time consuming and cumbersome. Also, the squeegee assemblies of these conventional floor scrubbers have guide wheels that extend radially outward beyond the lateral ends of the blades for guiding the assembly along walls. However, the guide wheels typically leave a gap between the blades and the wall so that dirty solution remains on the floor surface adjacent the wall.

SUMMARY OF THE INVENTION

Among the several objects and features of the present invention is the provision of improvements in an apparatus for treating a floor surface; the provision of such apparatus in which the control system permits the operator to switch operation of the scrubber between a traverse mode and an idle mode without letting go of the handle of the control system; the provision of such apparatus in which the control system permits the operator to switch operation of the scrubber between a forward direction of travel and a reverse direction of travel without letting go of the handle of the control system; and the provision of such apparatus having a control system that is easy to operate.

In general, apparatus of the present invention for treating the surface of a floor comprises a wheeled vehicle having a floor surface treating unit for treating the floor surface upon movement of the wheeled vehicle relative to the floor surface, and a drive motor operable to propel said wheeled vehicle relative to the floor surface. A control system for controlling operation of the apparatus comprises a handle mounted on the wheeled vehicle for being grasped by an operator to maneuver the vehicle relative to the floor surface. A traverse switch unit is movable between a first position corresponding to a traverse mode of the apparatus in which the vehicle is propelled by the drive motor to move relative to the floor surface and a second position corresponding to an idle mode of the apparatus in which the drive motor is ineffective to propel the vehicle to move relative to the floor surface. The traverse switch unit is mounted on the handle such that the traverse switch unit is accessible for movement by the operator toward the first position of the traverse switch unit corresponding to the traverse mode of the apparatus without the operator having to generally release the handle.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE PREFERRED EMBODIMENTS

Figure 1:
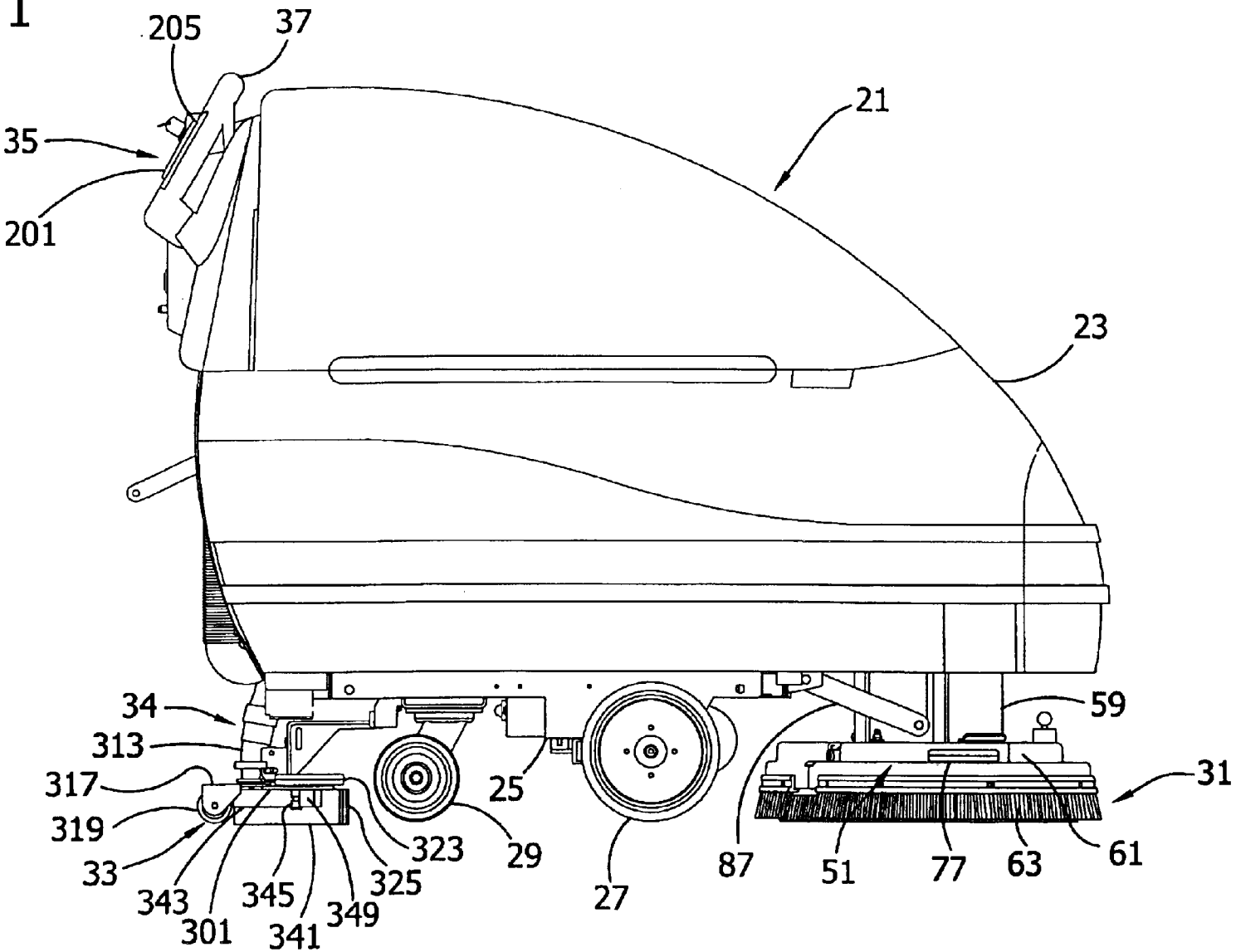
FIG. 1 is a side elevation of apparatus embodying the present invention for treating a floor surface.
Figure 2:
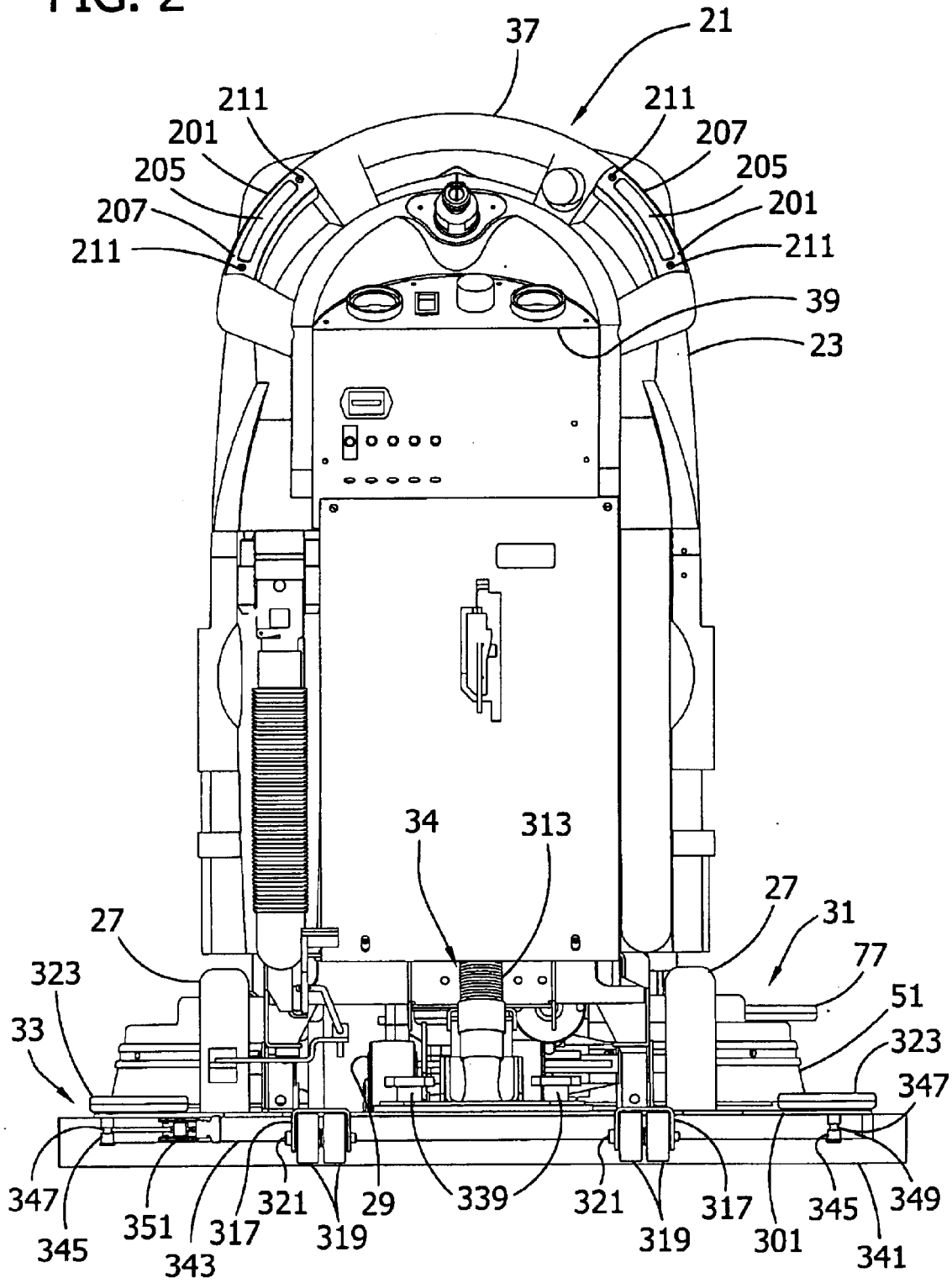
FIG. 2 is a rear view thereof.
Figure 3:
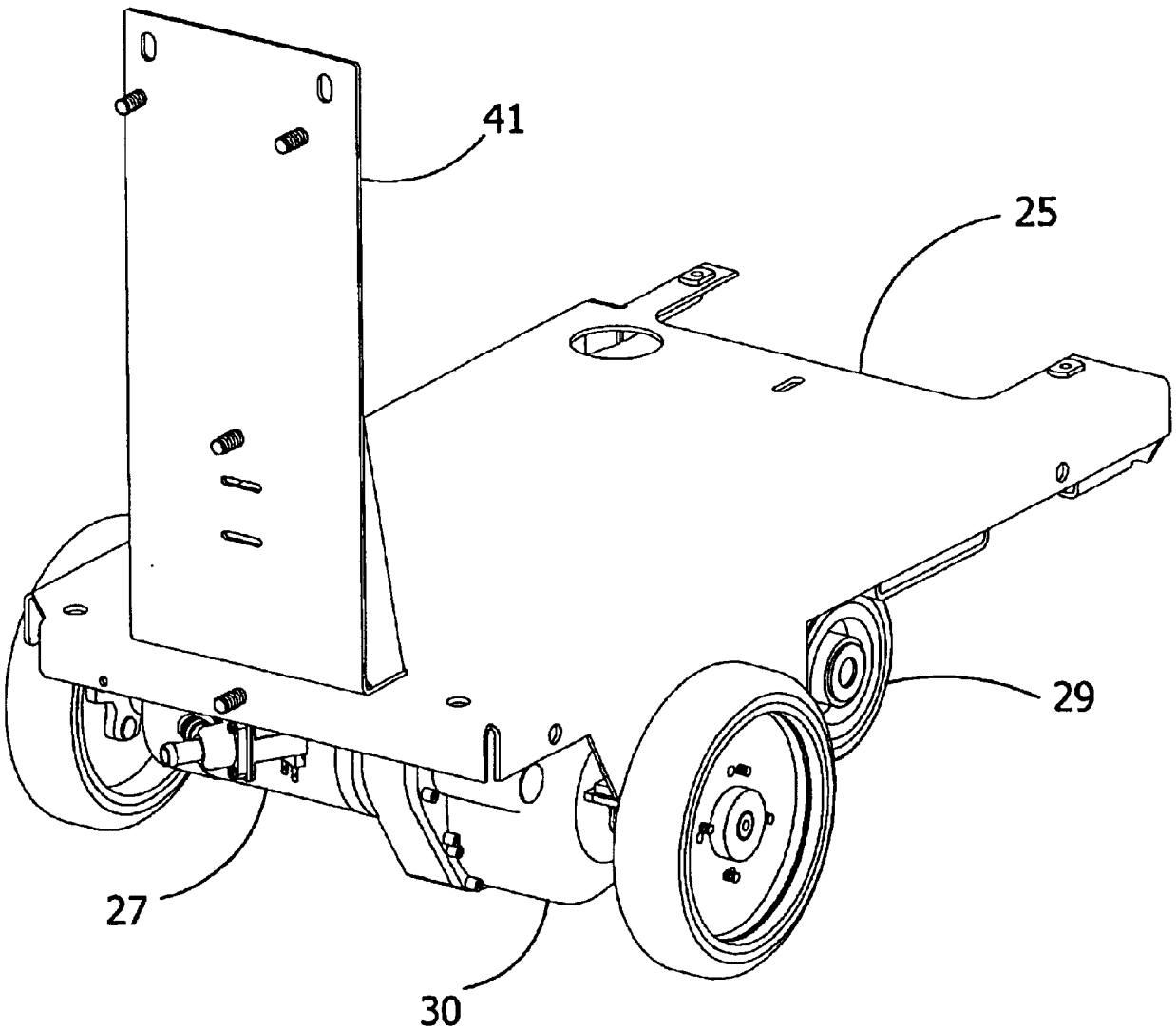
FIG. 3 is a perspective view of a chassis of the apparatus of FIG. 1.
Figure 6:
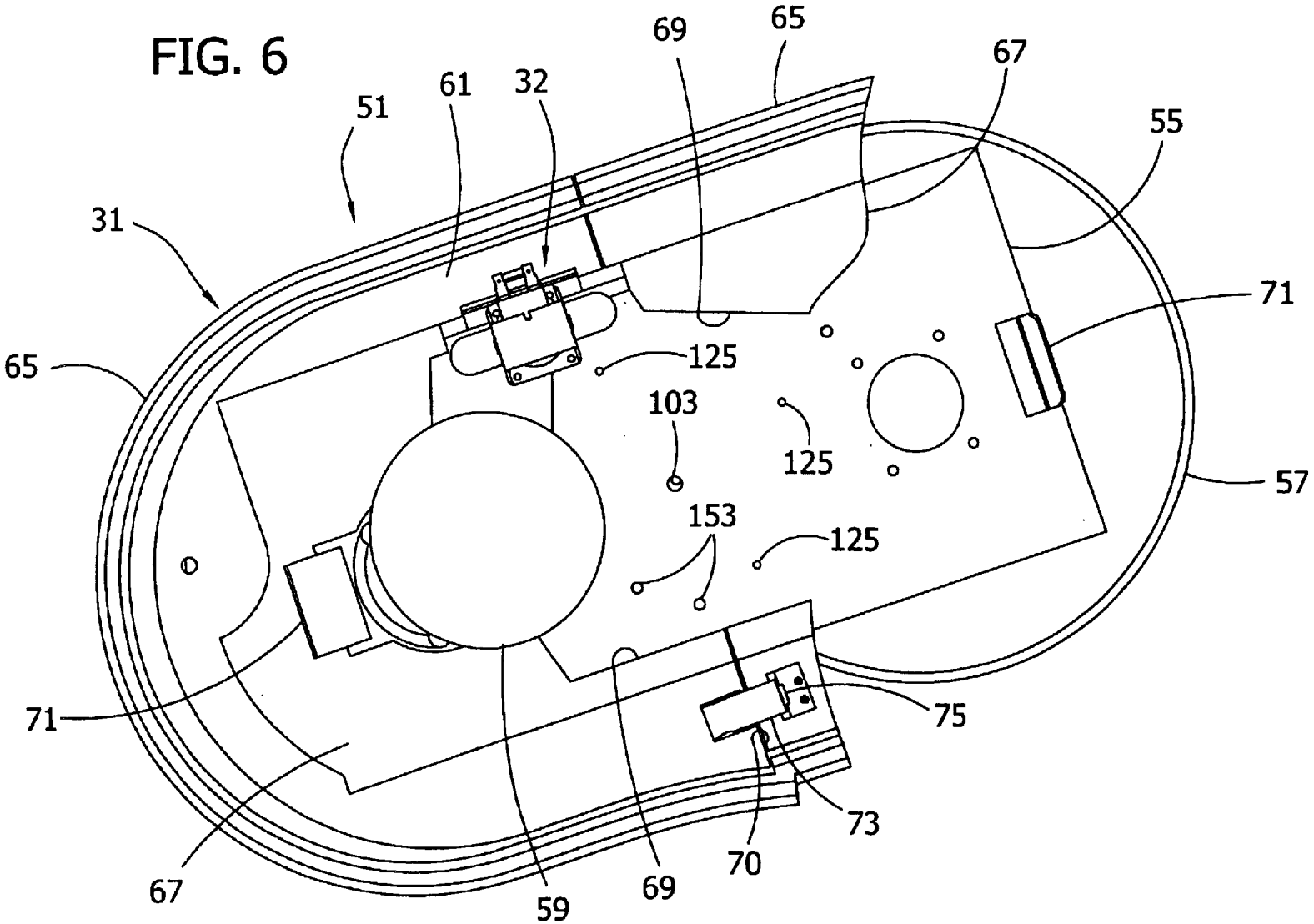
FIG. 6 is fragmentary top plan view of the brush head assembly with the mounting assembly and lift bracket removed to show additional structure of the brush head assembly.
Figure 7A:
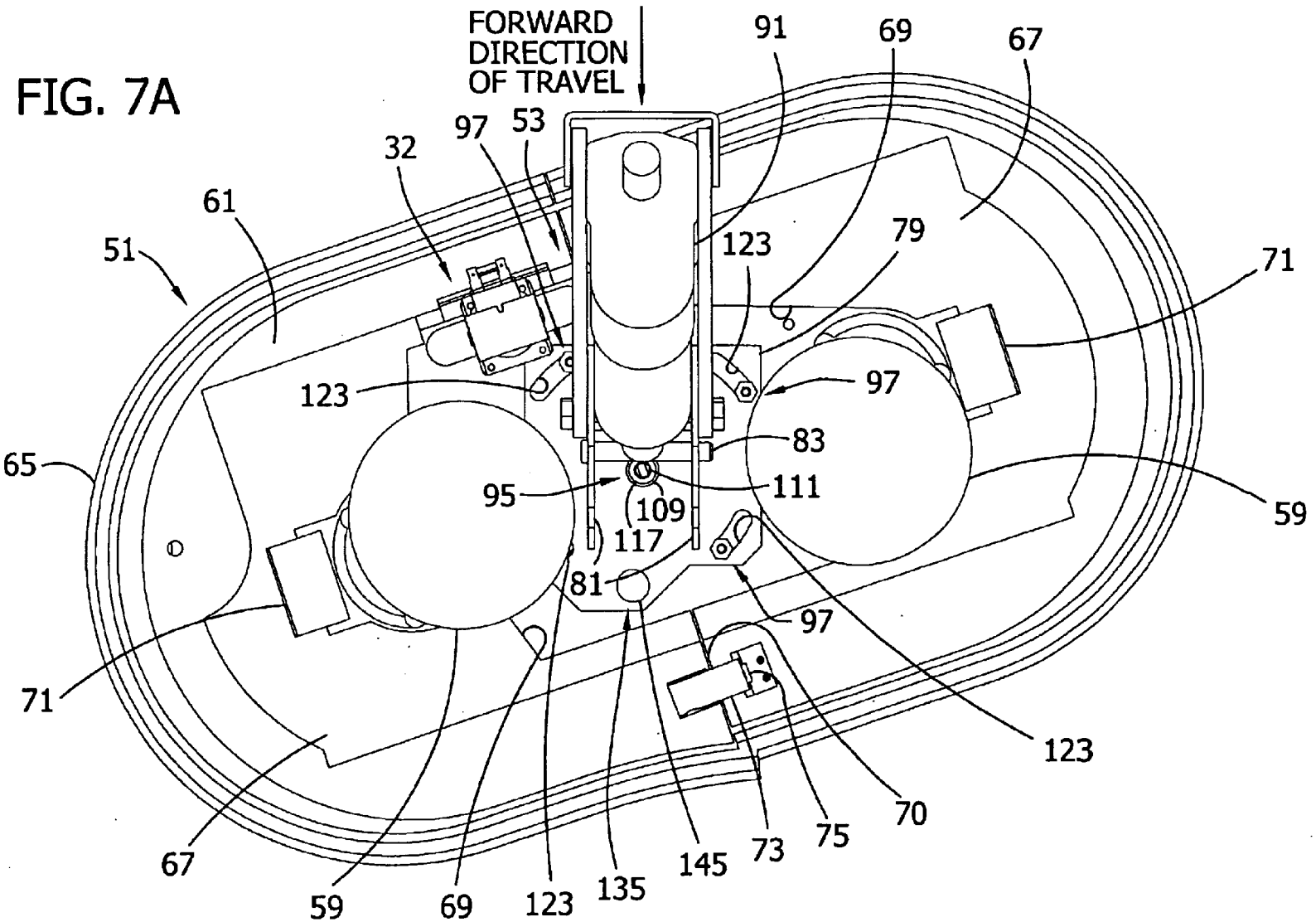
FIG. 7A is a top plan view of the brush head assembly with the brush head positioned in a first angular orientation.
Figure 7B:
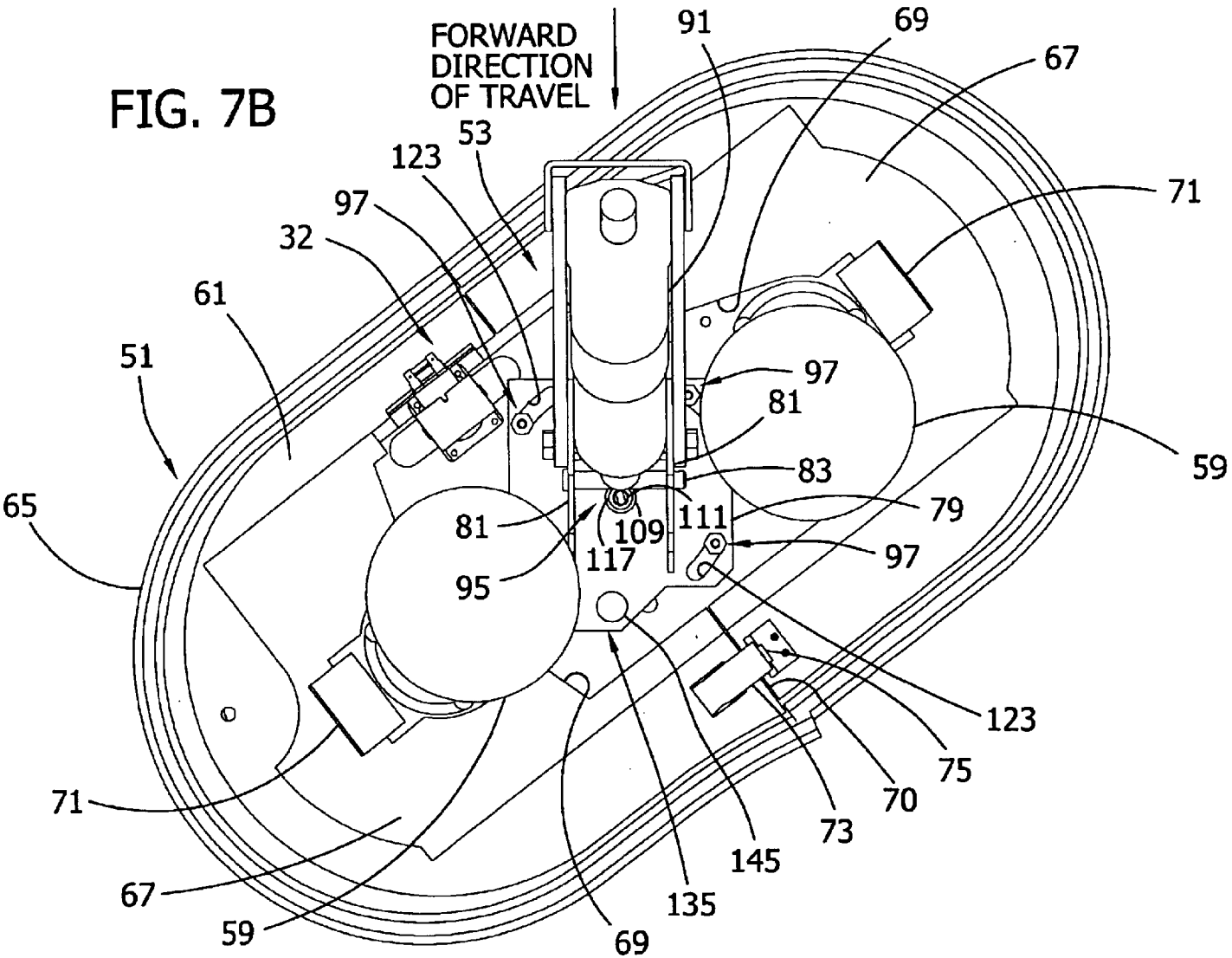
FIG. 7B is a top plan similar to that of FIG. 7A with the brush head positioned in a second angular orientation.

Now referring to the drawings, and in particular to FIG. 1, apparatus including the present invention for treating a floor surface is illustrated and described herein with reference to a floor scrubber, which is indicated in its entirety by the reference numeral 21. The floor scrubber 21 comprises a wheeled vehicle having a main housing 23 mounted on a chassis 25 (FIG. 3) and supported by a fixed wheel assembly 27 and a caster assembly 29 so that the scrubber is readily movable over a floor surface by an operator. The fixed wheel assembly 27 includes a motor 30 (FIG. 3) for driving rotation of the wheels of the fixed wheel assembly to self-propel the floor scrubber 21. The scrubber 21 also includes a solution delivery system (a portion of which is shown in FIGS. 6, 7A and 7B and generally indicated at 32) for delivering a cleaning solution onto the floor surface being cleaned, a head assembly, generally indicated at 31 and broadly defining a floor surface treating unit for agitating the cleaning solution while engaging the floor surface to treat the surface, a squeegee assembly, generally indicated at 33, for sweeping cleaning solution and dirt towards a recovery system (a portion of which is shown in FIGS. 1 and 2 and generally indicated at 34) wherein the recovery system suctions cleaning solution and dirt from the floor surface into the main housing 23.

The fixed wheel assembly 27 of the scrubber 21 of the illustrated embodiment defines a generally central vertical longitudinal plane of the scrubber extending longitudinally and vertically generally centrally between the wheels of the fixed wheel assembly. The scrubber 21 is propelled to move relative to the floor surface generally along the central vertical longitudinal plane of the scrubber in a forward or rearward direction of travel. As used herein, the forward direction of travel of the scrubber 21 refers to the direction of travel in which the cleaning solution is first agitated by the brush head assembly 31 and the squeegee assembly 33 is then moved over the recently cleaned segment of the floor surface to suction cleaning solution and dirt from the floor surface. For example, the forward direction of the travel of the scrubber 21 of the illustrated embodiment constitutes movement of the scrubber to the right in FIG. 1.

A control system, generally indicated at 35, includes a handle 37 mounted at the rear of the main housing 23 to provide the operator with a convenient means for guiding and maneuvering the floor scrubber 21 during operation. The control system 35 also includes a control panel 39 (FIG. 2) having controls in electrical communication with the various operating components of the floor scrubber 21 for controlling operation of the scrubber. General construction and operation of floor scrubbers similar to the floor scrubber 21 for treating a floor surface is known in the art and will not be further described herein except to the extent necessary to describe the present invention.

Figure 4:
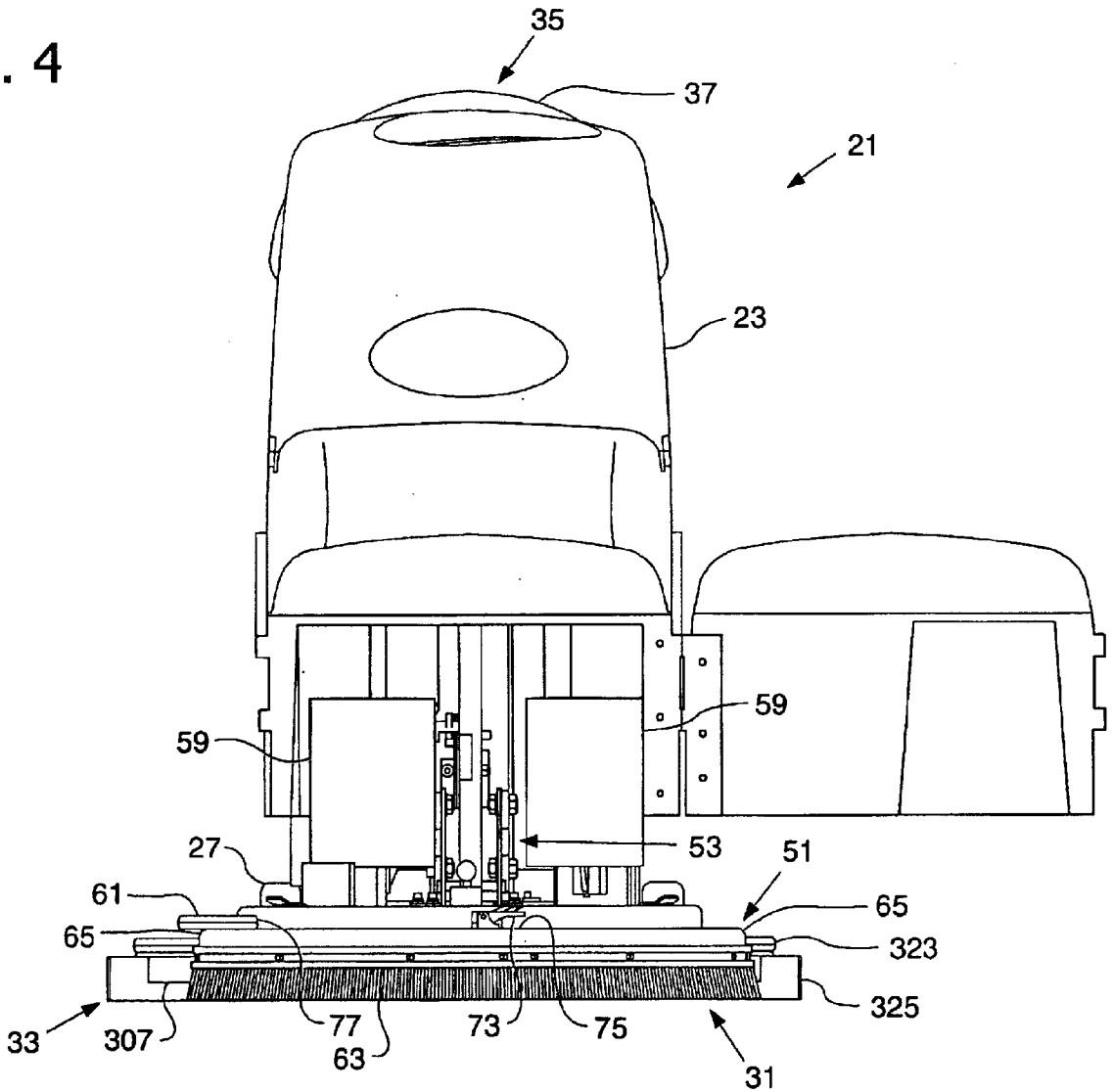
FIG. 4 is a front view of the apparatus of FIG. 1 with a front panel door of the apparatus in an open position to show additional features of the apparatus including a brush head assembly.
Figure 5:
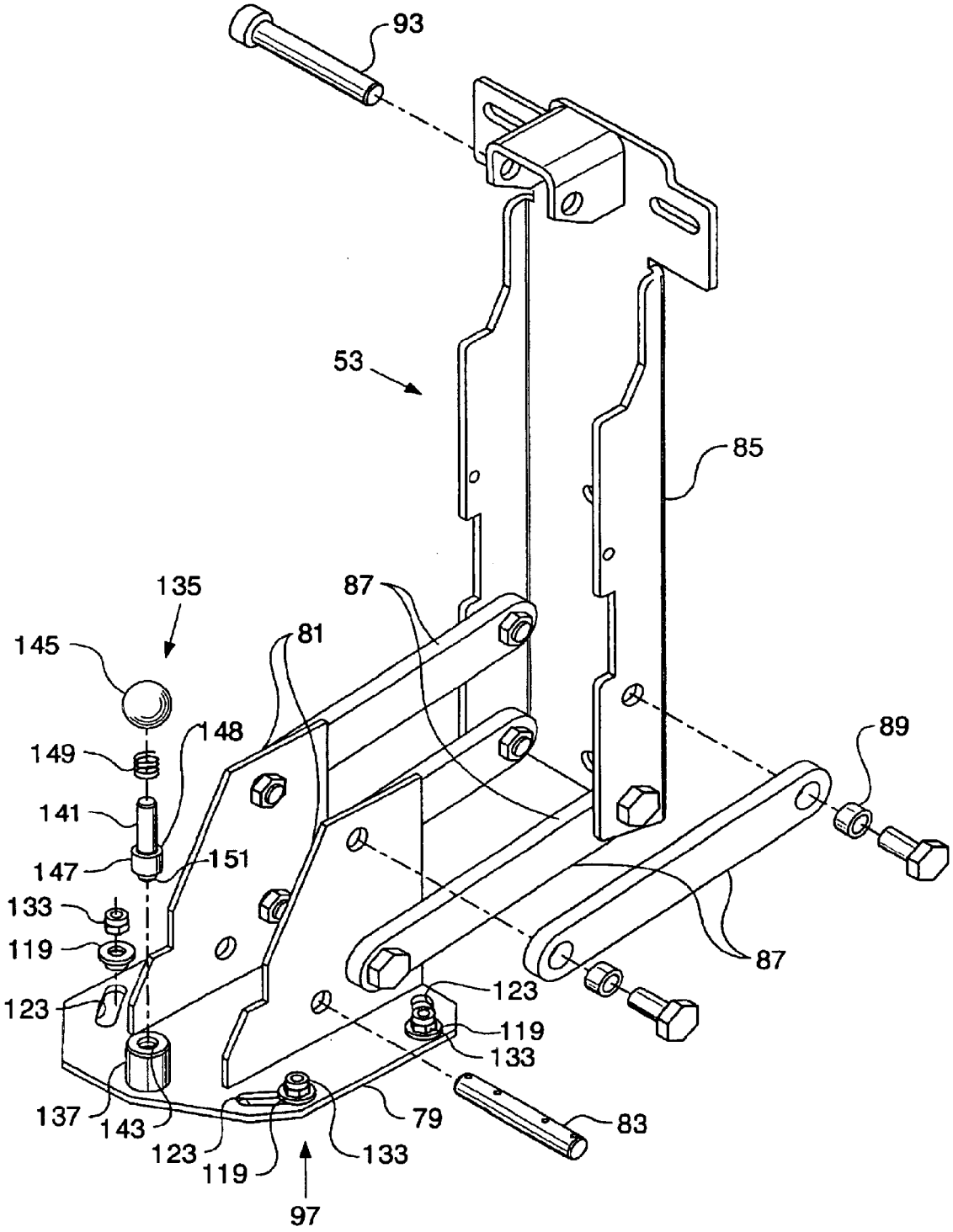
FIG. 5 is a perspective view of a mounting assembly for mounting a brush head of the apparatus of FIG. 1 on the chassis of FIG. 3, a lift bracket and a plunger assembly for releasably securing the brush head in a desired angular orientation relative to the chassis, with portions of the mounting assembly and the plunger assembly shown in exploded format.

The head assembly 31 is mounted on a front attachment plate 41 (FIG. 3) extending vertically up from the front end of the chassis 25. With particular reference to FIGS. 4–6, the brush head assembly 31 comprises a brush head, generally indicated at 51, and a lift unit, generally indicated at 53 (FIG. 5), connecting the brush head to the attachment plate 41 with the brush head carried beneath the lift unit. The brush head 51 includes a generally rectangular plate 55 (a portion of which is shown in FIG. 6), a pair of annular bristle brushes 57 (broadly, a floor treatment device, only one of which is shown in FIG. 6) supported by the brush head plate in laterally spaced relationship with each other, a corresponding pair of drive motors 59 (FIG. 4) mounted on the brush head plate in respective driving connection with the brushes to drive rotation of the brushes, and a brush housing 61 supported by the brush head plate to house the brushes. The brushes 57 of the illustrated embodiment are each thirteen inches in diameter and are spaced from each other approximately 0.2 inches. However, the size and positioning of the brushes 57 may vary without departing from the scope of this invention. Moreover, it is understood that a floor surfact treating unit other than bristle brushes 57 may be used, such as scrubbing pads, polishing pads and other similar floor surface treating units, and remain within the scope of the invention.

A skirt 63 constructed of bristles depends from the brush housing 61 about the peripheral edge of the housing. The brush housing 61 is sized larger than the annular brushes 57 such that the skirt 63 substantially surrounds the brushes above the floor surface to inhibit liquid cleaning solution from spraying outside the brush housing as the brushes agitate the solution during operation of the floor scrubber 21. The brush housing 61 of the illustrated embodiment is a removable housing of two-piece construction, with each section 65 of the brush housing having a jacket 67 sized for receiving a respective end of the brush head plate 55 such that the brush head plate supports each section of the brush housing. As shown in FIG. 6, a portion 69 of each jacket 67 is cut-out to accommodate the brush motors 59 and lift unit 53. The brush housing sections 65 are sized such that when they are seated on the brush head plate 55, the sections are in close contact relationship with each other along a central seam line 70 (FIG. 6).

Retention clips 71 constructed of a resilient material are mounted on the top of the brush head plate 55 generally at the laterally opposite ends of the plate to releasably secure the brush housing sections 65 on the brush head plate. A latch 73 and corresponding keeper 75 (FIG. 6) are mounted on the brush housing sections 65 in opposed relationship with each other adjacent the seam line 70 for releasably securing the sections together to define the brush housing 61 and to further secure the brush housing sections on the brush head plate 55. A guide wheel 77 (FIG. 4) is mounted on one of the brush housing sections 65 and extends laterally outward beyond the brush housing 61 for guiding the scrubber 21 adjacent walls or other obstacles and inhibiting the brush housing against impacting such walls or other obstacles.

With particular reference to FIGS. 5 and 7A, the lift unit 53 comprises a lift bracket 79 mounted generally centrally on the brush head plate 55 of the brush head 51. Side brackets 81 are secured to the lift bracket 79, such as by being welded thereto, and extend up from the lift bracket in generally parallel, laterally spaced relationship with each other. A pin 83 extends laterally between the side brackets 81 for reasons which will become apparent. The lift bracket further comprises a mounting bracket 85 (FIG. 5) constructed for connection with the front attachment plate 41 of the scrubber chassis 25 in a generally vertical orientation. Linkage arms 87 of the lift unit 53 connect the mounting bracket 85 to the side brackets 81 of the lift bracket 79 to secure the brush head 51 to the scrubber chassis 25. In the illustrated embodiment, the linkage arms 87 are secured to the mounting bracket 85 and side brackets 81 using sleeve bearings 89 that permit rotation of the linkage arms relative to the mounting bracket and side brackets. As a result, the brush head 51 is capable of up and down movement with the lift unit 53 relative to the chassis 25 and the floor surface, via the linkage arms 87 and the lift bracket 79, between a raised, inoperative position in which the brushes 57 are spaced from the floor surface and a lowered, operative position in which the brushes engage the floor surface.

Securing the linkage arms 87 to the mounting bracket 85 and side brackets 81 using the sleeve bearings 89 permits pivoting movement of the brush head 51 and lift bracket 79 relative to the mounting bracket about the horizontal axes of the sleeve bearings 89 to maintain the brush head 51 in a generally horizontal orientation as the lift unit raises and lowers the brush head 51 relative the floor surface. An actuator 91 (FIG. 7A) for actuating the lift unit 53 to move the brush head 51 between its raised and lowered positions extends between the mounting bracket 85 and the side brackets 81, and is pivotally connected at one end to the pin 83 extending between the side brackets and at its other end to a similar pin 93 (FIG. 5) extending laterally within the mounting bracket generally adjacent the front attachment plate 41. It is understood that the lift unit 53 may be moved up and down other than by an actuator 91 for raising and lowering the brush head 59 without departing from the scope of this invention.

Figure 8:
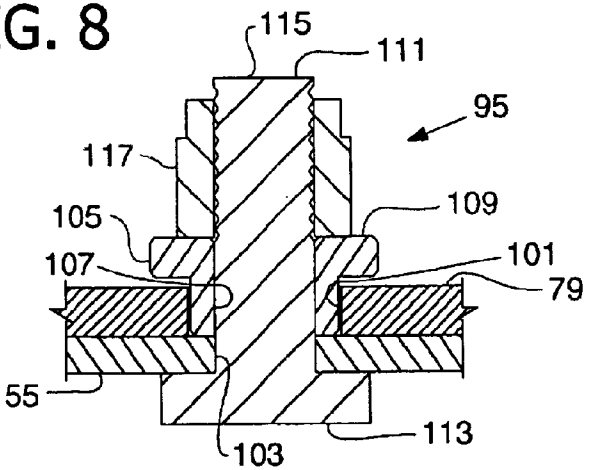
FIG. 8 is a vertical section of a pivot bushing of the brush head of FIG. 7A.

A pivot assembly, generally indicated at 95, provides a pivotal connection of the brush head 51 to the lift bracket 79 of the lift unit 53 to permit selective angular positioning of the brush head relative to the lift bracket about a generally vertically oriented pivot axis of the pivot assembly for varying the width of the cleaning path of the scrub brushes 57. As shown in FIG. 8, the lift bracket 79 has a central opening 101, positioned generally in the central vertical longitudinal plane of the scrubber 21, in coaxial alignment with a corresponding opening 103 (FIGS. 6 and 8) in the brush head plate 55 located generally at the center of length of the brush head such that the brushes 57 are equally radially spaced from the brush head plate opening. The central opening 101 of the lift bracket 79 is sized larger than the brush head plate opening 103. A tubular bushing 105 of the pivot assembly 95 is received in the lift bracket central opening 101 to seat on the brush head plate 55 with a central bushing passage 107 of the pivot bushing in registry with the brush head plate opening 103. An annular flange 109 (broadly, a support member of the pivot assembly 95) extends radially outward from the upper end of the pivot bushing 105 to a diameter substantially larger than that of the lift bracket central opening 101 to limit axial movement of the bushing in the central opening. However, the flange 109 is spaced slightly above the lift bracket 79 to permit rotation of the bushing 105 relative to the lift bracket and to prevent the lift bracket from being secured tightly down against the brush head plate 55. A screw 111 defines a pivot pin that extends up through the brush head plate opening 103 and the bushing passage 107 and has a head 113 at one end sized larger than the brush head plate opening. The other end 115 of the screw 111 extends up out of the bushing passage 107 and threadably receives a nut 117 (broadly, a retaining member) thereon to secure the pivot bushing 105 in the lift bracket central opening 101 down against the brush head plate 55 and to removably connect the brush head 51 to the lift bracket 79 of the lift unit 53.

The pivot bushing 105, screw 111 and corresponding nut 117 are thus secured to the brush head plate 55 for conjoint rotation therewith in the lift bracket central opening 101 about the pivot axis of the pivot assembly 95. The brush head plate 55 of the illustrated embodiment is capable of pivoting movement about the pivot axis of the pivot assembly 95 relative to the central vertical longitudinal plane of the scrubber 21 to angularly position the brush head 51 of the head assembly 31 between a first angular position (FIG. 7A) having a cleaning path width defined as the outermost transverse extent of the brushes relative to the forward direction of travel of the scrubber (indicated by arrow in FIGS. 7A and 7B), and a second angular position (FIG. 7B) having a cleaning path width narrower than that of the first angular position of the brush head.

FIG. 7A shows the brush head 51 positioned in its first angular position relative to the central vertical longitudinal plane of the scrubber 21 at an angle of about 19°. The cleaning path width of the brush head 51 in this first angular position is approximately 26 inches. FIG. 7B shows the brush head 51 positioned in its second angular position at an angle of about 37.5°, which defines a narrower cleaning path width of approximately 24 inches. It is understood that the brush head 51 may be selectively positioned between more than two angular positions relative to the central longitudinal vertical plane of the scrubber 21 to provide multiple available cleaning path widths without departing from the scope of this invention. The brush head may also be positionable through a greater range of angular positions, such as about 0°–90°. However, angular positions in which the brushes 57 at least partially overlap within the cleaning path width are generally preferred.

Figure 9:
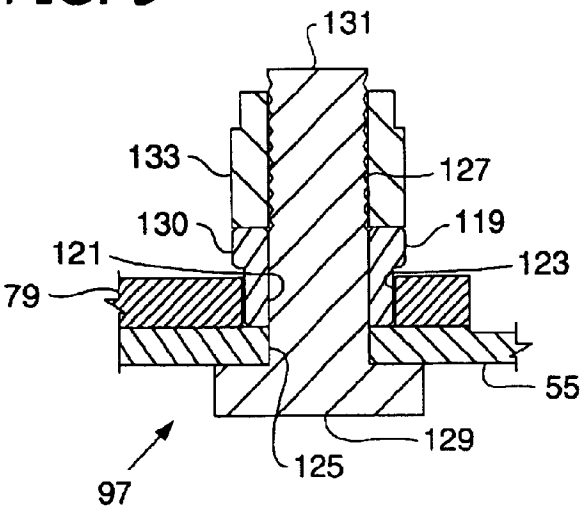
FIG. 9 is a vertical section of a slide bushing of the brush head of FIG. 7A.

The brush head 51 is further pivotally connected to the lift bracket 79 of the lift unit 53 by a slide assembly 97 (FIGS. 5, 7A, 7B and 9) comprising four slide bushings 119 (three of which are shown in FIG. 5 and one of which is shown in FIG. 9) disposed in radially spaced relationship with the pivot bushing 105 (see FIGS. 7A, 7B). Each slide bushing 119 is tubular, having a central passage 121 extending therethrough, and is disposed in a respective guide slot 123 formed in the lift bracket 79. Corresponding openings 125 (FIG. 6) are formed in the brush head plate 55 in radially spaced relationship with the pivot axis of the lift unit 53 and are located for registry with a respective one of the guide slots 123 throughout pivoting movement of the brush head 51 between the first and second angular positions of the brush head. A screw 127 (FIG. 9) broadly defines a pin extending up through the brush head plate opening 125 and the bushing passage 121 and has a head 129 at one end sized larger than the brush head plate opening. The other end 131 of the screw 127 extends up out of the bushing passage 121 and threadably receives a nut 133 (broadly, a retaining member) thereon to secure the slide bushing 119 in the corresponding slot 123 of the lift bracket 79 down against the brush head plate 55, and to further removably connect the brush head 51 to the lift bracket 79 of the lift unit 53. As with the pivot bushing 105, the slide bushings 119 are sufficiently long so that when the nuts 133 are tightened down against the slide bushings 119, the slide bushings 119 prevent the lift bracket from being tightened down against the brush head plate 55. The arcuate guide slots 123 formed in the lift bracket 79 permit arcuate movement of each slide bushing 119 therein upon pivoting movement of the brush head plate 55 relative to the lift bracket 79 about the pivot axis of the pivot assembly 95. The upper end of each slide bushing has an annular flange 130 (broadly, a support member of the slide assembly 97) extending radially outward therefrom. The lifting force applied to the lift bracket 79 by the actuator 91 to raise the brush head 51 to its raised position is thereby distributed to the pivot bushing 105 and the slide bushings 119 by the flanges 109, 130 of the pivot bushing and slide bushings.

Figure 10:
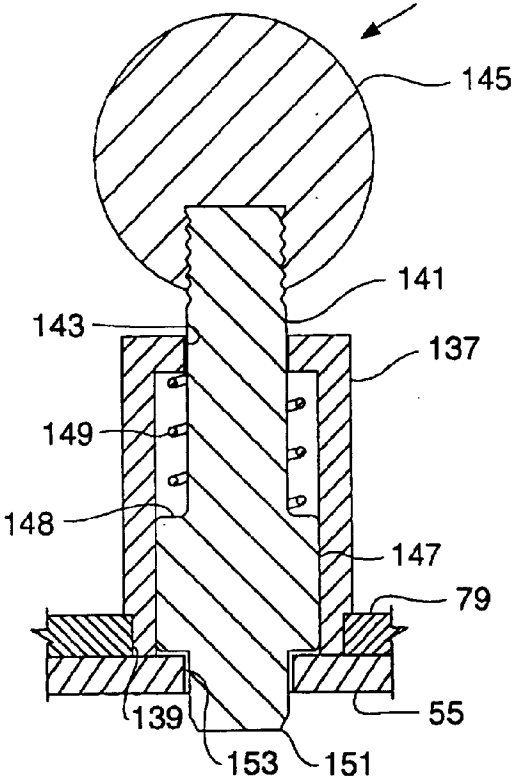
FIG. 10 is a vertical section of the plunger assembly shown in FIG. 5.

The head assembly 31 is releasably secured in its first and second angular positions by a plunger assembly, generally indicated at 135 in FIG. 7A. With particular reference to FIGS. 5 and 10, the plunger assembly 135 comprises a tubular housing 137 disposed in an opening 139 of the lift bracket 79 and extending up from the lift bracket. A plunger pin 141 extends up through the housing 137 and outward therefrom through an opening 143 in the upper end of the housing. The plunger pin 141 is threaded at its upper end to threadably receive a knob 145 thereon for ease of grasping and operating the plunger assembly 135. A central portion 147 of the plunger pin 141 is disposed in the housing 137 for up and down sliding movement of the pin the housing. The central portion 147 of the pin 141 has a diameter substantially greater than the opening 143 in the upper end of the housing to define a spring seat 148 of the plunger assembly. A spring 149 circumscribes the plunger pin 141 within the housing 137 and seats on the spring seat 148 defined by the central portion 147 of the plunger pin intermediate the central portion of the pin and the upper end wall of the spring housing. A lower portion 151 of the plunger pin 141 extends down from the central portion 147 of the pin for reasons which will become apparent.

As shown in FIG. 6, the brush head plate 55 includes a pair of locating holes 153, corresponding to the first and second angular positions of the brush head 51. The locating holes 153 are arranged in spaced relationship with each other and in radially spaced relationship with the pivot axis of the pivot assembly 95. The locating holes 153 are located in the brush head plate 55 for movement into registry with the opening 139 in the lift bracket 79 upon rotation of the brush head 51 about the pivot axis of the pivot assembly 95. The spring 149 of the plunger assembly 135 biases the plunger pin 141 down against the brush head plate 55 such that when one of the locating holes 153 corresponding to one of the first and second angular positions of the brush head 51 comes into registry with the opening 139 in the lift bracket 79, the bias of the spring urges the plunger pin down into the locating hole in the brush head plate. The lower portion 151 of the plunger pin 141 is received in the locating hole 153 to releasably lock the brush head 51 in the selected first or second angular position during operation of the scrubber 21.

Figure 11:
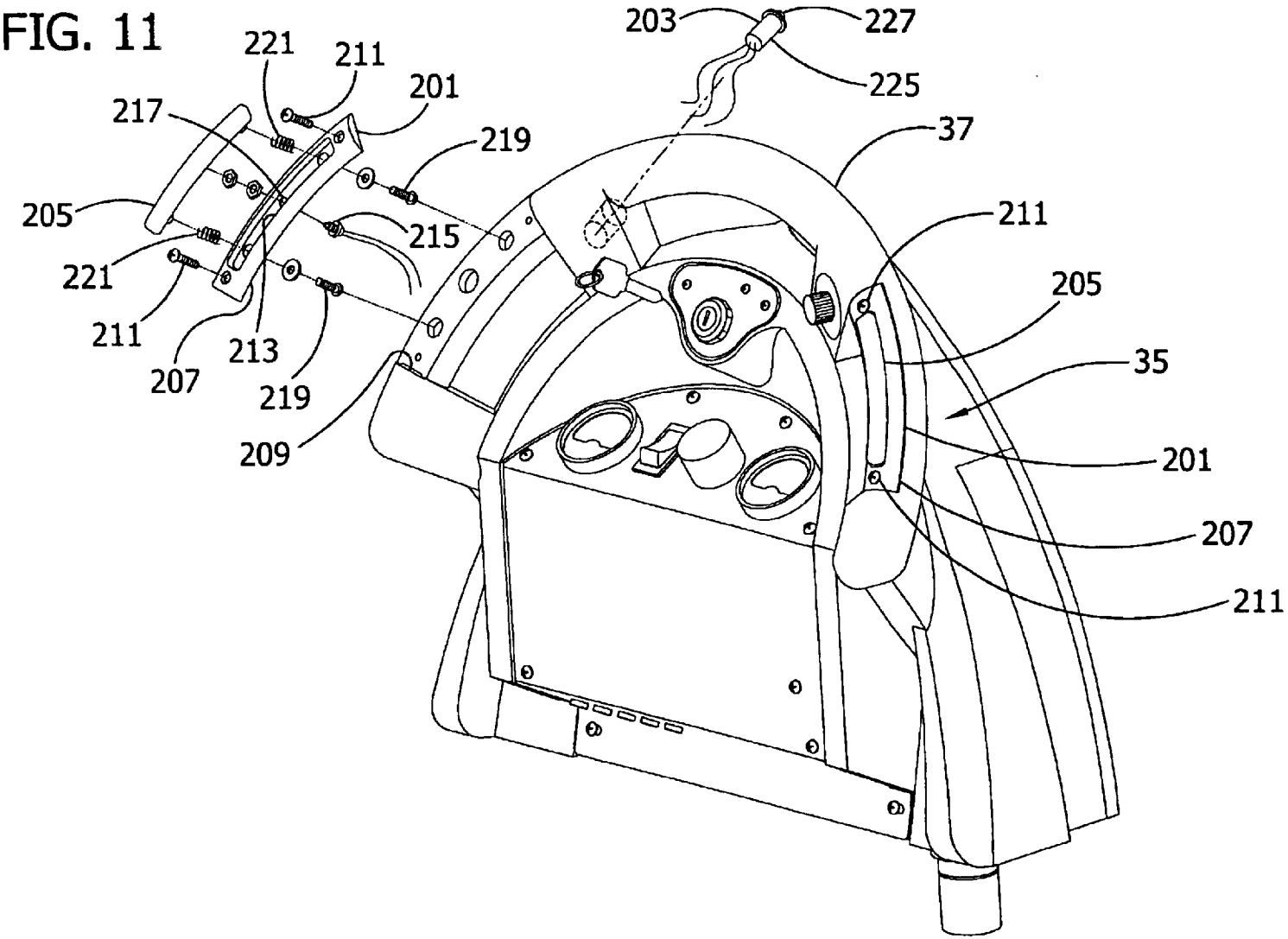
FIG. 11 is a perspective view of a control system of the apparatus of FIG. 1 with a traverse switch unit and a directional switch unit shown in exploded format.

Now referring particularly to FIGS. 2 and 11, the handle 37 of the control system 35 is generally semi-circular and extends arcuately (e.g. longitudinally) substantially the full width of the main housing 23, and more particularly the handle extends longitudinally a distance approximately equal to the spacing between the wheels of the fixed wheel assembly 27. As seen best in FIG. 1, the handle 37 is slightly reclined from vertical for ease of grasping by the operator. The control system 35 further comprises a pair of traverse switch units 201 and a directional switch unit 203 (FIG. 11) for controlling forward and reverse travel of the floor scrubber 21 over the floor surface. The traverse switch units 201 include a pair of generally arcuate switch bars 205, or buttons, mounted on the face of the handle 37 in spaced relationship with each other. The switch bars 205 are positioned on arcuate segments of the handle corresponding to the general location of the operator's palm and thumb when the operator grasps the handle with both hands to operate the scrubber 21. Each switch bar 205 is received in a respective housing 207 inset in a recessed portion 209 of the front face of the handle 37 and mounted to the handle by suitable fasteners 211. The switch bar housings 207 each have an arcuate channel 213 therein for receiving the switch bar 205 in the housing. A push button-type switch 215 (FIG. 11) disposed in the handle 37 extends outward through a central opening 217 of the switch bar housing 207 generally into the arcuate channel 213 of the housing for engagement by the switch bar 205.

The switch 215 is in electrical communication with the drive motor 30 and is movable between an extended position corresponding to an idle mode of the scrubber 21 and a depressed position corresponding to a traverse mode of the scrubber in which the switch sends a signal to the motor to propel the scrubber in either a forward or reverse direction. The switch bar 205 is connected to the switch bar housing 207 by screw fasteners 219 (FIG. 11) that permit movement of the switch bar in the channel 213 of the housing between an extended position in which the switch bar is spaced from the switch 215 and a recessed position in which the switch bar engages and pushes the switch inward to the depressed position of the switch. A pair of springs 221 (FIG. 11) are disposed in each switch bar housing 207 on opposite sides of and in spaced relationship with the switch 215 for biasing the switch bar 205 toward its extended position. Spring cups (not shown) are formed in the switch bar 205 to retain the springs 221 in their proper position in the channel 213 of the switch bar housing 207.

Still referring to FIG. 11, the directional switch unit 203 is mounted on the rear face of the handle 37 generally adjacent one of the traverse switch units 201 for ease of reaching and operating the directional switch unit simultaneously with the traverse switch unit using only one hand. The directional switch unit 203 comprises a housing 225 recessed into the rear face of the handle 37 and a push button-type switch 227 disposed in the housing and extending outward therefrom. The directional switch unit 203 is also in electrical communication with the drive motor 30 and is movable between an extended position in which the push button-type switch 227 is positioned relatively outward of the housing 225 and a depressed position in which the push button-type switch 227 is moved inward from its extended position relative to the housing 225. In the extended position, no signal is sent by the directional switch unit 203 to the drive motor 30 such that the floor scrubber 21 is controlled to move forward in response to operation of the floor scrubber 21 in its traverse mode. In the depressed position, a signal is sent by the directional switch unit 203 to the drive motor 30 to control movement of the floor scrubber 21 in a reverse direction in the traverse mode of the floor scrubber. A spring (not shown) in the housing 225 biases the push button-type switch 227 to its extended position.

Figure 12:
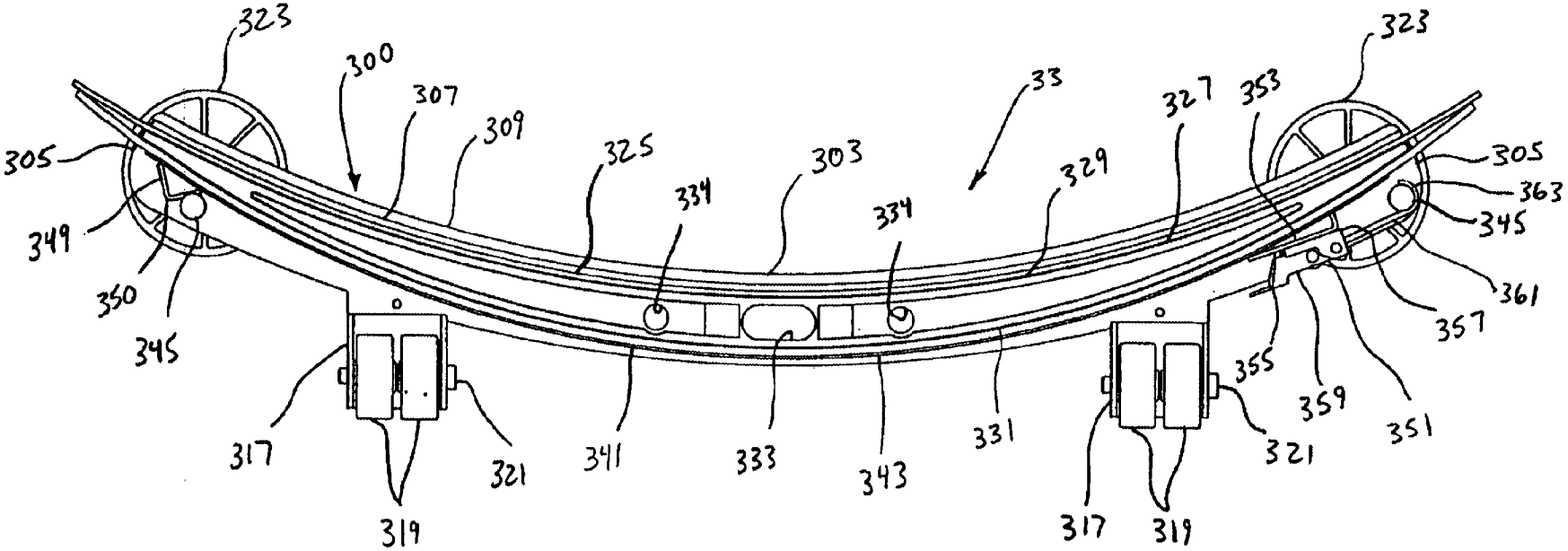
FIG. 12 is a bottom plan view of a squeegee assembly of the apparatus of FIG. 1.

Now referring particularly to FIGS. 2 and 12, the squeegee assembly 33 comprises a frame member, generally indicated at 300, including an elongate, arcuate assembly plate 301 curving lengthwise generally forward from a central portion 303 of the assembly plate outward to opposite ends 305 of the plate. A retaining flange 307 (FIG. 12) having a curvature substantially the same as that of the assembly plate 301 depends therefrom generally adjacent a front edge 309 of the plate. The retaining flange 307 of the illustrated embodiment is welded to the assembly plate 301. A vacuum line 313 (FIGS. 1 and 2) of the recovery system is connected to the top of the assembly plate 301 in registry with a central opening (not shown) in the plate to provide fluid communication between the recovery system and the floor surface being cleaned. A sealing gasket (not shown) is positioned on the assembly plate 301 about the central opening to provide sealing engagement between the vacuum line 313 and the assembly plate to inhibit loss of vacuum in the recovery system during operation of the scrubber 21. A pair of brackets 317 are attached to the assembly plate 301 and extend rearward from the plate, and two trailing wheels 319 are mounted on each bracket 317 by a respective axle bolt 321. Horizontally oriented guide wheels 323 are rotatably mounted on the top of the assembly plate 301 adjacent the opposite ends 305 of the plate and are sized to extend radially (e.g., lengthwise) outward beyond the opposite ends of the assembly plate to guide the squeegee assembly 33 along walls and other obstacles and to inhibit the assembly plate against impacting walls and other obstacles.

A front blade 325 of the squeegee assembly 33 is sized for face-to-face abutting engagement against the retaining flange 307 (FIG. 12) along substantially the entire length of the retaining flange and has a height sufficient to extend down below the retaining flange for engaging the floor surface being cleaned. The front blade 325 of the illustrated embodiment is constructed of a resilient, flexible material, such as urethane, and has vertically oriented ribbing (not shown) or slots (not shown). When the blade 325 is moved forward over the floor surface in engagement with the floor, the blade will bend slightly rearward due to friction with the floor surface and the ribbing creates small gaps between the blade and floor surface to allow water to pass beneath the blade. The length of the front blade 325 is such that the blade extends lengthwise outward beyond the opposite ends 305 of the assembly plate 301.

An elongate, arcuate spacer 327 (FIG. 12) having a front face 329 and a rear face 331 is connected to the underside of the assembly plate 301. The front face 329 of the spacer 327 has a curvature substantially the same as that of the retaining flange 307 for conforming the front blade 325 to the curvature of the flange upon assembly of the squeegee assembly 33. The spacer 327 has a central opening 333 in registry with the central opening of the assembly plate 301 and is secured to the assembly plate by a pair of screw fasteners (not shown) extending up through openings 334 in the spacer and through corresponding laterally extending slots (not shown) formed in the assembly plate. A nut (not shown) is threadably received on each of the screw fasteners to secure the spacer 327 on the assembly plate 301. The slots formed in the assembly plate 301 permit lateral (e.g., forward and rearward) movement of the spacer 327, fasteners and nut relative to the assembly plate for reasons which will become apparent. The screw fasteners further extend up from the nuts through the sealing gasket and are used to connect the vacuum line 313 to the assembly plate 301. Knobs 339 (FIG. 2) having internal threads are threadably connected to the screw fasteners to secure the vacuum line 313 on the assembly plate 301 in sealing engagement with the sealing gasket.

A rear blade 341 of the squeegee assembly 33 is constructed of a gum rubber material and is resiliently flexible to conform to the curvature of the rear face 331 of the spacer 327. The rear blade 341 has a length sized so that the blade extends lengthwise outward beyond the guide wheels 323 for sweeping solution from the floor surface immediately adjacent (e.g., up against) walls and other obstacles. For example, the front blade 325 of the illustrated embodiment is approximately 32.125 inches long, the rear blade 341 is approximately 35.125 inches long. A clamping band 343 abuts against the rear blade 341 and extends substantially the length of the assembly plate 301, but is substantially shorter than the rear blade. For example, the clamping band 343 of the illustrated embodiment is about 32.64 inches long. The clamping band 343 is constructed from a strip of 16 gage stainless steel formed sufficiently thin (e.g., about 0.06 inches) such that the band is resiliently flexible for conforming generally to the curvature of the rear face 331 of the spacer 327.

Figure 13:
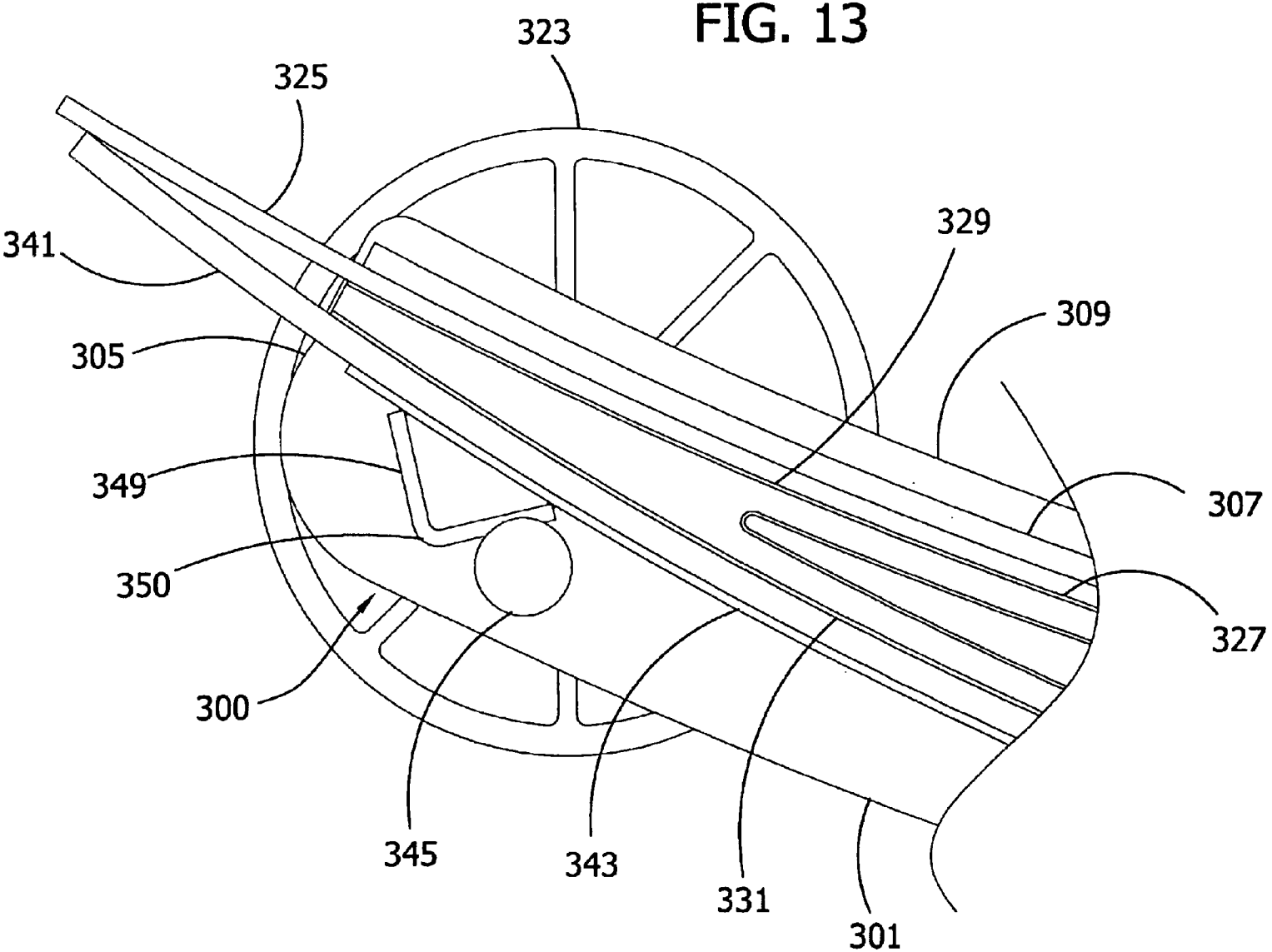
FIG. 13 is a fragmentary bottom plan view of the squeegee assembly of FIG. 12 illustrating one end of the squeegee assembly.

A pair of posts 345 (broadly, interengageable members of the frame member 300) depend from the assembly plate 301 generally adjacent the opposite ends 305 of the plate. As best seen in FIG. 13, a generally V-shaped wedging member 349 (broadly, an interengageable member of the clamping band 343) is secured to the rear face of the clamping band adjacent one end of the band for engaging the post 345 at one end 305 of the assembly plate 301 to position the clamping band on the squeegee assembly 33. The wedging member 349 has an apex 350 located transversely outward (e.g., rearward) of the clamping band 343 a distance greater than the spacing between the clamping band and the post 345 depending from the assembly plate. It is understood that the wedging member 349 may be other than V-shaped, or an interengageable member other than a wedging member may be used, such as a flange or a hook extending outward from the clamping band, without departing from the scope of this invention, as long as the interengageable member of the clamping band extends transversely outward from the clamping band 343 a distance greater than the spacing between the clamping band and the post 345 depending from the assembly plate 301 upon assembly of the squeegee assembly 33. A circular groove 347 (FIG. 2) is formed in each post 345 for reasons which will become apparent.

Figure 14A:
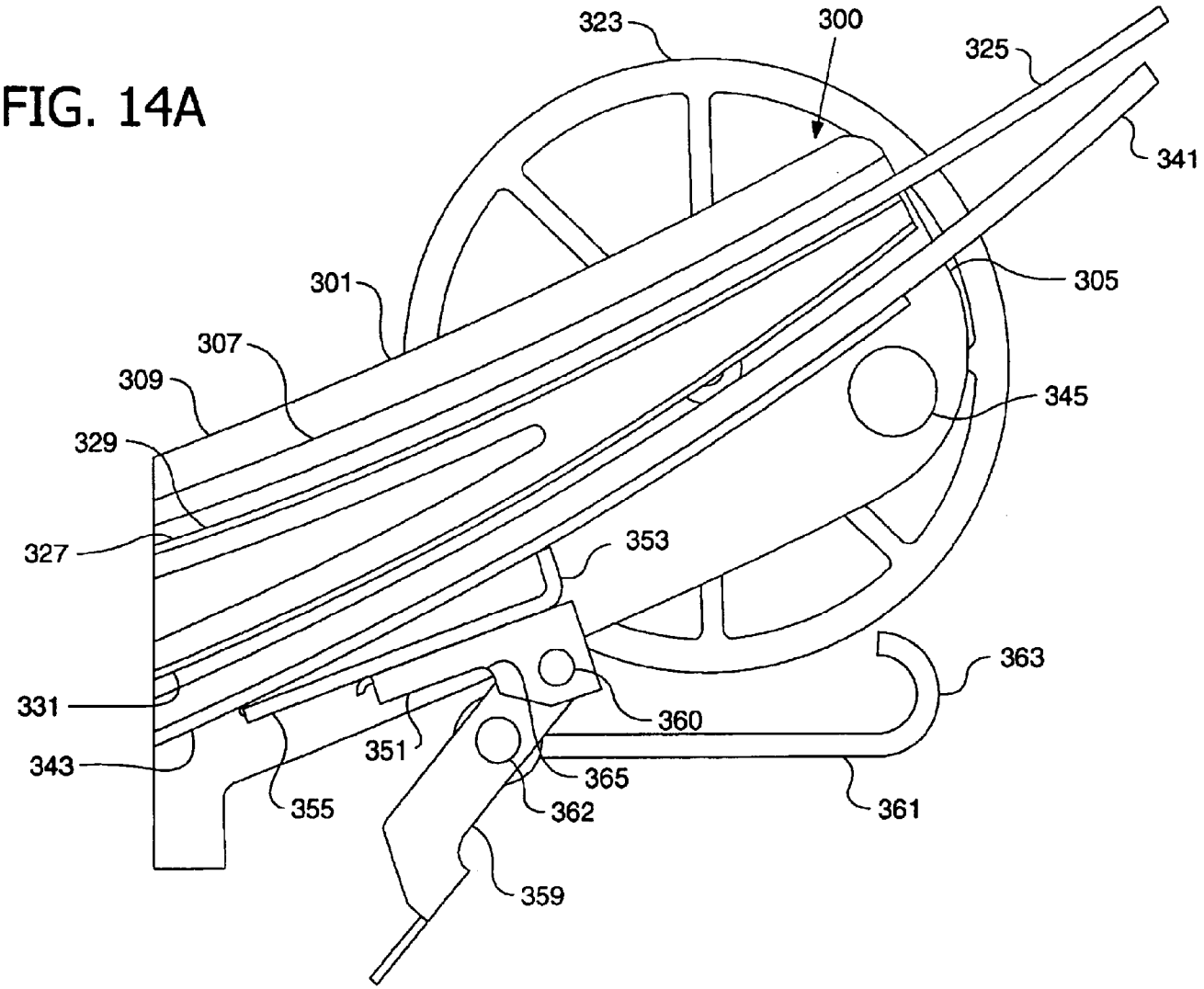
FIG. 14A is a fragmentary bottom plan view of the squeegee assembly of FIG. 12 illustrating another end of the squeegee assembly with a quick-release mechanism of the squeegee assembly shown in an unclamped configuration.
Figure 14B:
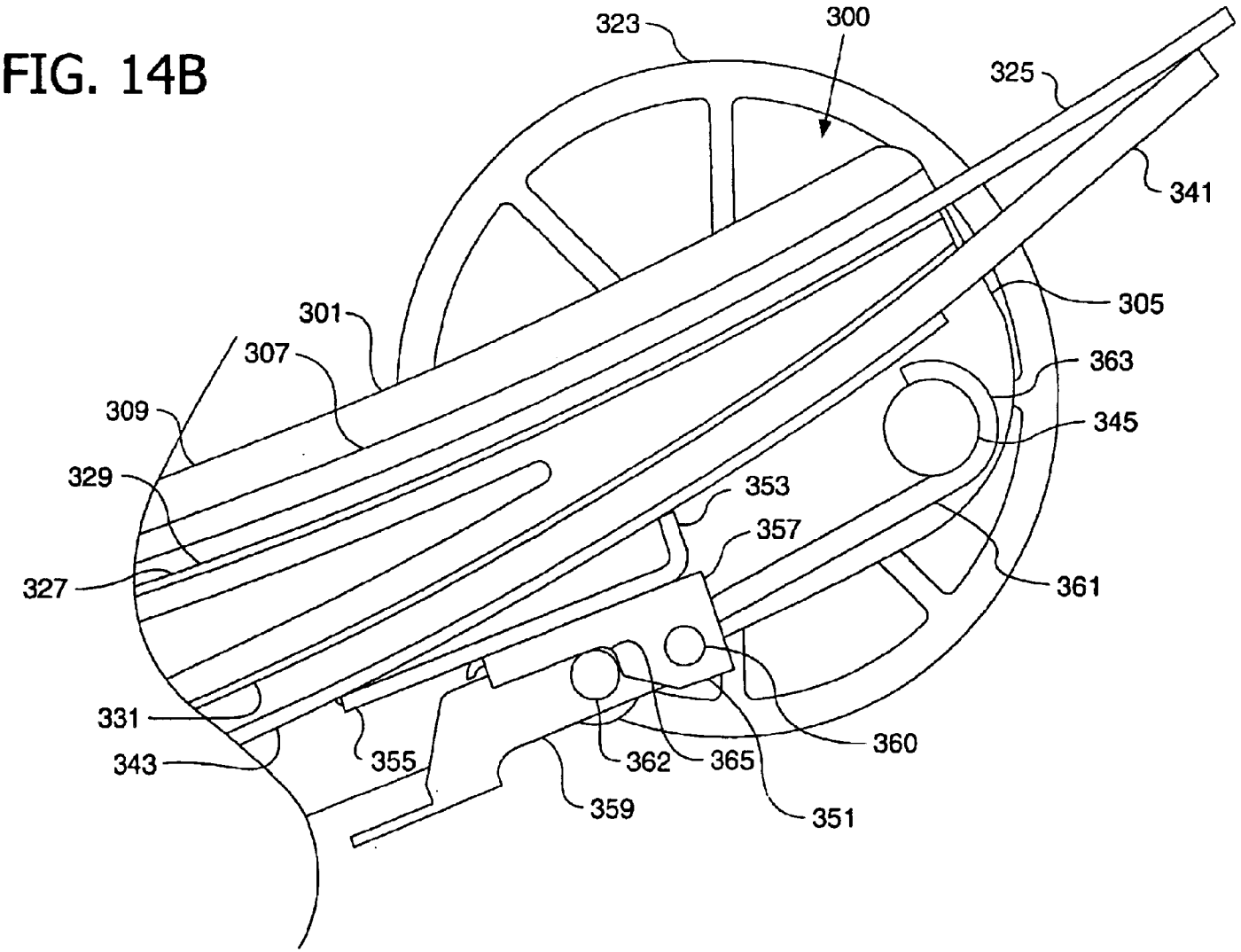
FIG. 14B is a fragmentary bottom plan view similar to that of FIG. 14A with the quick-release mechanism shown in a clamped configuration.

A quick-release mechanism, generally indicated at 351 (FIGS. 12, 14A, 14B), is also secured to the rear face of the clamping band 343 generally adjacent the end of the band opposite the end adjacent to which the wedging member 349 is secured. In the illustrated embodiment, a generally L-shaped mounting member 353 (FIG. 14A) is secured to the clamping band 343, such as by being welded thereto, to form a mounting surface 355 for the quick-release mechanism 351 disposed at an angle relative to the back of the clamping band. For example, the mounting member shown in FIGS. 14A and 14B is mounted on the back of the clamping band 343 such that the mounting surface 355 is angled outward from the band at an angle of about 8–10°.

The quick-release mechanism 351 comprises a bracket 357 secured to the mounting surface 355 of the L-shaped mounting member 353. A toggle 359 is pinned 360 to the bracket 357 for pivoting movement relative to the bracket and clamping band 343, and a hook member 361 is pinned as indicated at 362 at one end to the toggle and has a hook 363 at its other end sized for seating within the groove 347 in the respective post 345 depending from the assembly plate 301. The toggle 359 is capable of pivoting movement relative to the bracket 357 between a position away from the bracket corresponding to an unclamped configuration (FIG. 14A) of the quick-release mechanism 351 wherein the hook member 361 can be pivoted relative to the toggle 359 for seating the hook 363 in the groove 347 of the post 345 and a position inward against the mounting bracket corresponding to a clamped configuration (FIG. 14B) of the quick-release mechanism. A contoured portion 365 of the bracket 357 provides sufficient clearance for the toggle 359 to be moved between the clamped and unclamped configurations of the quick-release mechanism 351.

In a preferred method of assembling the squeegee assembly 33, such as when new front and/or rear blades 325, 341 are installed in the assembly, the assembly plate 301 is turned upside down as shown in FIG. 12 so that the retaining flange 307 extends up from the plate. The front blade 325, which is generally straight prior to assembly, is placed lengthwise on the assembly plate 301 in generally abutting relationship with the retaining flange 307. The spacer 327 is then placed on the plate 301 with the opening 333 in the spacer in registry with the corresponding central opening of the assembly plate. The front face 329 of the spacer 327 slightly bends the front blade 325 according to the curvature of the front face of the spacer and the retaining flange, but does not squeeze the front blade therebetween. The spacer 327 is secured to the assembly plate 301 by inserting the fastener screws through the spacer and the laterally extending slots formed in the assembly plate and then threading the nuts onto the screws.

Next, the rear blade 341 is set loosely on the assembly plate 301 with the blade disposed between the rear face 331 of the spacer 327 and the posts 345 depending from the assembly plate. With the quick-release mechanism 351 in its unclamped configuration (FIG. 14A), the clamping band 343 is placed on the assembly plate 301 between the rear blade 341 and the posts 345, with the wedging member 349 and the quick-release mechanism 351 facing rearward. The clamping band 343 is positioned such that the wedging member 349 abuts one of the posts 345 (FIG. 13) longitudinally outward of the post. The hook member 361 of the quick-release mechanism 351 is pivoted relative to the toggle 359 until the hook 363 can be placed around the other post 345 to seat within the groove 347 in the post. In this unclamped configuration of the quick-release mechanism 351, the bracket 357 of the quick-release mechanism and the mounting surface 355 formed by the mounting member 353 of the clamping band 343 are generally skewed relative to the hook member 361 such that the band and the rear blade 341 are spaced from the rear face 331 of the spacer 327.

The quick-release mechanism is then moved to its clamped configuration (FIG. 14B), thereby tensioning the hook 363 and urging the bracket 357 of the clamp 351 generally inward against the mounting surface 355 of the mounting member 353. This results in the bracket 357 and mounting surface 355 moving into generally parallel relationship with the hook member 361, with the rear blade 341 secured between the spacer 327 and the clamping band 343. As the quick-release mechanism 351 is moved to its clamped configuration, the clamping band 343 is pulled lengthwise toward the post 345 about which the hook 361 is seated (e.g., to the right in FIGS. 14A and 14B), causing the wedging member 349 at the other end of the clamping band to wedge between the post 345 and the clamping band such that the clamping band becomes tensioned by the lengthwise pulling of the quick-release mechanism. This tensioning of the clamping band 343 urges the clamping band to flex forward toward the retaining flange 307. The forward movement of the clamping band 343 further urges the rear blade 341, the spacer 327 and the forward blade 325 to move forward relative to the assembly plate 301 and retaining flange 307 so that the forward blade becomes clamped between the retaining flange and the front face 329 of the spacer and the rear blade becomes clamped between the rear face 331 of the spacer and the clamping band.

To operate the floor scrubber 21, the operator grasps the handle 37, with at least one palm resting on the handle on or adjacent to a corresponding one of the switch bars 205 of the control system traverse switch units 201. If movement in the forward direction of travel is desired, the operator does not depress the directional switch unit 203 on the rear of the handle 37, thereby allowing the directional switch to remain it its extended position corresponding to forward operation of the floor scrubber 21. The operator then squeezes the handle 37 with at least one hand and, with the operator's palm or thumb, exerts inward pressure against at least one of the switch bars 205. Each switch bar 205 against which inward pressure is exerted moves inward in the channel 213 of the switch bar housing 207 against the bias of the springs 221 in the housing. The switch bar 205 pushes inward against the switch 215 to move the switch to its depressed position corresponding to the traverse mode of the floor scrubber 21. In response thereto, the control system 35 sends a signal to the drive motor 30 to drive the floor scrubber 21 in the forward direction of travel.

As the floor scrubber 21 moves in the forward direction of travel, liquid cleaning solution is dispensed from the solution delivery system 32 onto the floor surface beneath the brush head 51. The brushes 57 are rotatably driven by the brush motors 59 to agitate the cleaning solution and scrub the floor surface to promote dirt removal from the surface whereby the dirt becomes generally suspended in the cleaning liquid to create a dirty solution. As the scrubber 21 is moved further forward, the blades 325, 341 of the squeegee assembly 33 sweep the dirty solution. The curvature of the front and rear blades 325, 341 urges the dirty solution inward toward the central portion 303 of the assembly plate 301. Dirty solution passes through the ribbing or slots in the front blade 325 into a suction chamber defined by the front blade, the rear blade 341 and the spacer 327 and is suctioned from the floor surface via the openings in the spacer 327 and the assembly plate 301 into the vacuum line 313 of the recovery system of the floor scrubber 21.

To return the scrubber 21 to its idle mode, the operator simply releases both switch bars 205 on the handle 37 so that the bias of the springs 221 in the switch bar housings 207 urges the switch bars outward relative to the housing, thereby allowing the switches 215 to return to the extended position corresponding to the non-traverse mode.

To operate the floor scrubber 21 in the reverse direction, the operator uses a finger, such as an index finger, on the hand grasping the handle 37 adjacent the directional switch unit 203 to move the push button-type switch 227 to its depressed position. In response thereto, the control system 35 sends a signal to the drive motor 30 indicating that reverse movement is desired. While maintaining the push button-type switch 227 in its depressed position, the operator squeezes the handle 37 in the manner described above to operate the floor scrubber 21 in its traverse mode whereby the floor scrubber 21 is now powered to move in the reverse direction.

In view of the above, it will be seen that the several objects of the invention are achieved and other advantageous results attained. When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. An apparatus for treating the surface of a floor, said apparatus comprising:

a wheeled vehicle having a floor surface treating unit for treating the floor surface upon movement of the wheeled vehicle relative to the floor surface, and a drive motor operable to propel said wheeled vehicle relative to the floor surface; and a control system for controlling operation of said apparatus, the control system comprising a handle mounted on said wheeled vehicle for being grasped by an operator to maneuver said vehicle relative to the floor surface, and a traverse switch unit movable between a first position corresponding to a traverse mode of the apparatus in which the vehicle is propelled by the drive motor to move relative to the floor surface and a second position corresponding to an idle mode of the apparatus in which the drive motor is ineffective to propel the vehicle to move relative to the floor surface, the traverse switch unit being mounted on the handle such that the traverse switch unit is accessible for movement by the operator toward the first position of the traverse switch unit corresponding to the traverse mode of the apparatus without the operator having to generally release the handle, wherein the traverse switch unit is mounted on a portion of the handle adapted to be grasped by the operator whereby grasping of said portion of the handle affects movement of the traverse switch unit toward its first position corresponding to the traverse mode of the apparatus.

2. The apparatus as set forth in claim 1, wherein the traverse switch unit is biased toward its second position corresponding to the idle mode of the apparatus, grasping of said portion of the handle effecting movement of the traverse switch unit against said bias toward the first position of the traverse switch unit corresponding to the traverse mode of the apparatus, the bias being sufficient to move the traverse switch unit toward its second position corresponding to the idle mode of the apparatus when the operator releases said portion of the handle.

3. The apparatus as set forth in claim 2, Apparatus further comprising a directional switch unit mounted on the handle for selectively controlling the direction of travel of the vehicle between a forward direction of travel and a reverse direction of travel, the directional switch unit being located relative to the traverse switch unit such that the directional switch unit is accessible by the operator for controlling the direction of travel of the vehicle without the operator having to generally release said portion of the handle.

4. The apparatus as set forth in claim 3, wherein the traverse switch unit and the directional switch unit are mounted on the handle sufficiently close to each other such that the traverse switch unit and directional switch unit are accessible by one hand of the operator grasping said portion of the handle without the operator releasing said one hand from said portion of the handle.

5. The apparatus as set forth in claim 4, wherein the handle has a front and a back, the handle being arranged such that the front of the handle generally faces the operator when the operator grasps the said portion of the handle whereby when the operator grips the said portion of the handle the palm of the one hand of the operator generally engages the front of the handle and the fingers of said one hand generally engages the back of the handle, the traverse switch unit being mounted on the front of the handle such that the palm of the one hand generally engages the traverse switch unit to move the traverse switch unit toward its first position corresponding to the traverse mode of the apparatus when the operator grips the handle.

6. The apparatus as set forth in claim 5, wherein the directional switch unit is mounted on the back of the handle.

7. The apparatus as set forth in claim 4, wherein the traverse switch unit comprises an elongate button, the front of the handle having a channel sized for receiving the elongate button, the traverse switch unit further comprising at least one biasing member disposed in the channel and acting against the elongate button to bias the button generally outward relative to the handle toward the second position of the traverse switch unit corresponding to the idle mode of the apparatus.

8. The apparatus as set forth in claim 7, wherein the traverse switch unit further comprises a switch housing mounted on the front of the handle and having an elongate channel formed therein to define said channel sized for receiving the elongate button.

9. The apparatus as set forth in claim 4, wherein the traverse switch unit is a first traverse switch unit positioned for movement toward its second position corresponding to the traverse mode of the apparatus upon grasping of the handle by said one hand of the operator, the apparatus further comprising a second traverse switch unit mounted on the handle in spaced relationship with said first traverse switch unit generally at a portion of the handle grasped by the other hand of the operator.

10. The apparatus as set forth in claim 1, wherein the handle is generally arcuate.

11. The apparatus as set forth in claim 10, wherein the traverse switch unit comprises an elongate button, the handle having a channel sized for receiving the elongate button, the traverse switch unit further comprising at least one biasing member disposed in the channel and acting against the elongate button to bias the button generally outward relative to the handle toward the second position of the traverse switch unit corresponding to the idle mode of the apparatus.

12. The apparatus as set forth in claim 11, wherein the elongate button is arcuate in accordance with the curvature of the handle.

13. The apparatus as set forth in claim 12, wherein the traverse switch unit further comprises an arcuate housing mounted on a front of the handle and having an elongate, arcuate channel formed therein to define said channel sized for receiving the elongate button.

14. The apparatus as set forth in claim 10, wherein the handle is generally semi-circular.

15. The apparatus as set forth in claim 10, wherein the wheeled vehicle further has a fixed wheel assembly supporting the wheeled vehicle for ease of movement relative to the floor surface, the fixed wheel assembly having a pair of wheels in laterally spaced relationship, the handle of the control system having a length at least about equal to the lateral spacing between the wheels of the fixed wheel assembly.

* * * * *

UNITED STATES PATENT AND TRADEMARK OFFICE

CERTIFICATE OF CORRECTION

PATENT NO. : 6,760,947 B2
DATED : July 13, 2004
INVENTOR(S) : William R. Stuchlik It is certified that error appears in the above-identified patent and that said Letters Patent is hereby corrected as shown below:

Column 4,
Line 25, delete “surfact” and replace with -- surface --; and

Column 13,
Line 43, prior to “further” delete “Apparatus”;

Signed and Sealed this

First Day of February, 2005

JON W. DUDAS
*Director of the United States Patent and Trademark Office*